United States Patent [19]

Stackhouse, Jr.

[11] Patent Number: 4,532,841

[45] Date of Patent: Aug. 6, 1985

[54] SAW BLADE GUARD

[75] Inventor: James L. Stackhouse, Jr., St. Louis, Mo.

[73] Assignee: Emerson Electric Co., St. Louis, Mo.

[21] Appl. No.: 597,997

[22] Filed: Jun. 18, 1984

Related U.S. Application Data

[63] Continuation of Ser. No. 356,321, Mar. 10, 1982, abandoned.

[51] Int. Cl.[3] ..... B26D 1/14

[52] U.S. Cl. ..... 83/102.1; 83/440.2; 83/478; 83/544; 144/251 R

[58] Field of Search ..... 83/478, 481, 860, 100, 83/102.1, 397, 440.2, 544–546; 144/251 R; 51/268

[56] References Cited

U.S. PATENT DOCUMENTS

| | | | |
|---|---|---|---|
| 2,781,067 | 2/1957 | Kaley | 51/268 |
| 3,105,530 | 10/1963 | Peterson | 83/478 |
| 3,519,041 | 7/1970 | Palmer | 144/251 R |
| 3,880,032 | 4/1975 | Green | 83/102.1 |
| 4,176,571 | 12/1979 | Batson | 83/478 |

*Primary Examiner*—James M. Meister
*Assistant Examiner*—John L. Knoble
*Attorney, Agent, or Firm*—Charles E. Markham

[57] ABSTRACT

A hood-like saw blade guard for a radial arm saw is mounted for free vertical movement on a support frame detachably connected to the suspended saw blade driving motor housing. The guard extends over the entire saw blade when in its downward position and is contoured on both sides so as to be easily elevated upon contact with a workpiece, one contoured side is closed and offset radially from the saw blade to provide a sawdust chute and permit vertical removal of the guard from the frame. A spreader with an anti-kickback device thereon is mounted for vertical adjustment on the frame and guards the open contoured side, and vertically adjustable hold-down means on the frame variably limits vertical upward movement of the guard so as to hold down a workpiece when ripping.

3 Claims, 16 Drawing Figures

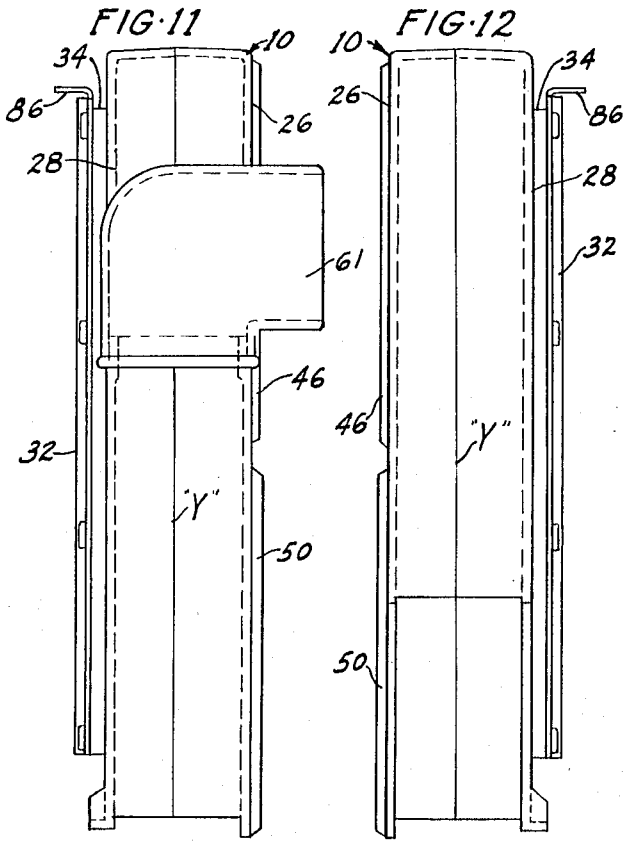
FIG·12
FIG·11
"Y"
10
26
28
32
34
46
50
61
86
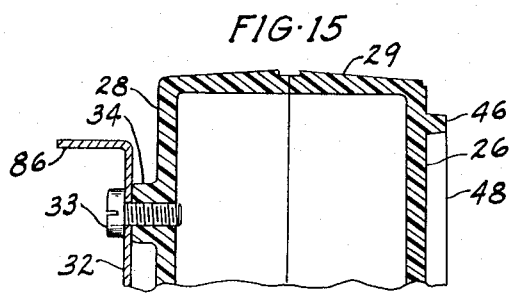
FIG·15
26
28
29
32
33
34
46
48
86
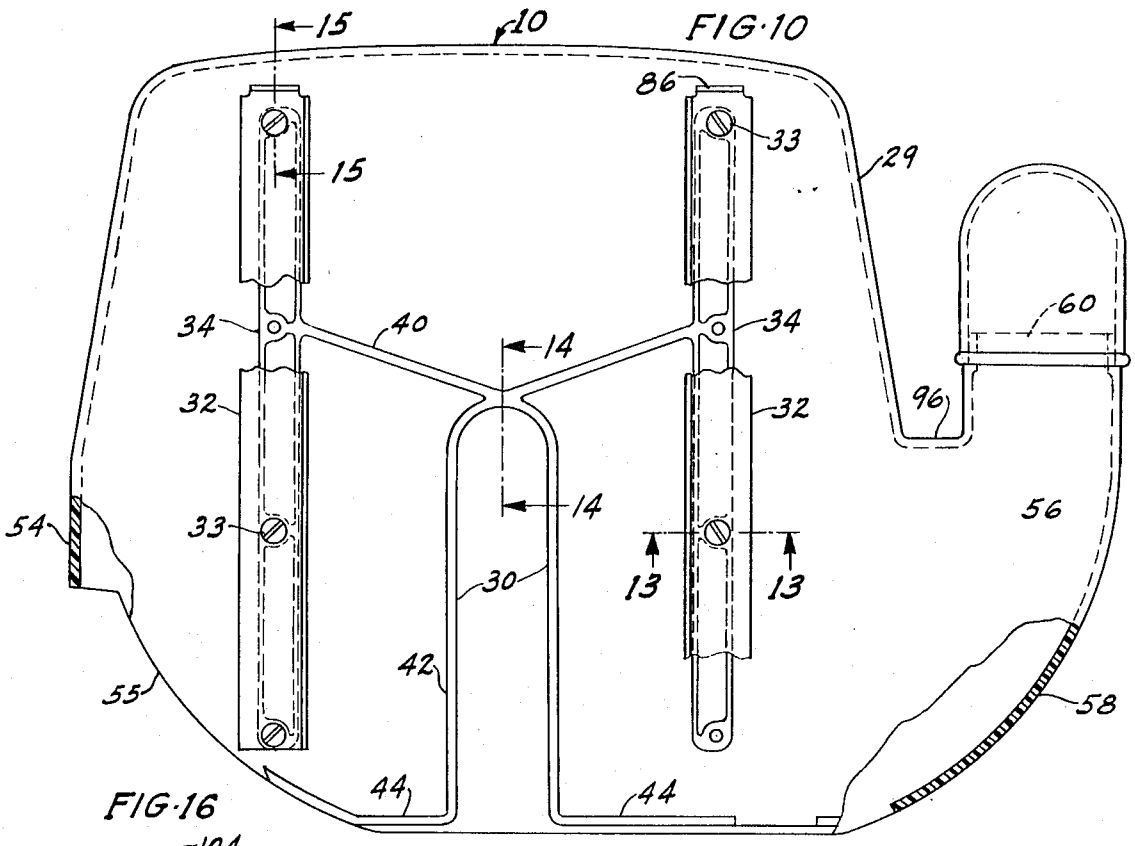
FIG·10
10
13
14
15
29
30
32
33
34
40
42
44
54
55
56
58
60
86
96
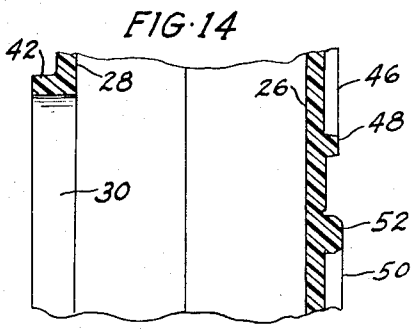
FIG·14
26
28
30
42
46
48
50
52
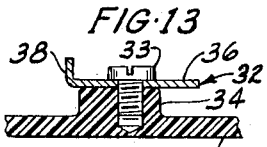
FIG·13
28
32
33
34
36
38
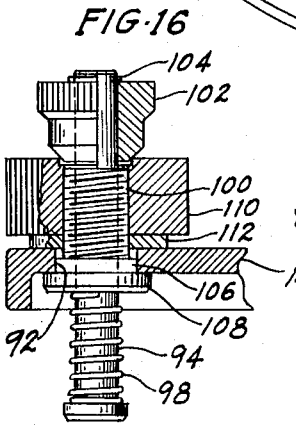
FIG·16
14
92
94
98
100
102
104
106
108
110
112

SAW BLADE GUARD

This is a continuation of application Ser. No. 06/356,321 filed Mar. 10, 1982 now abandoned.

This invention relates to guards for power driven circular saw blades and particularly to a freely vertically movable hood-like guard for a radial arm saw which extends over the entire saw blade when in a downward position.

BACKGROUND OF THE INVENTION

Saw blade guards for circular saw blades mounted on a horizontal shaft and suspended above a worktable as in a radial arm saw have conventionally consisted of hood-like structures fixed to the saw blade motor housing and extending over and shrouding only the upper half of the saw blade. Various retractable lower guard devices hinged on this fixed upper half guard and extending downward therefrom on opposite sides of the saw blade to guard the lower half thereof have been proposed and widely used. In another prior device a hood-like upper half guard is mounted for axial rotational adjustment on a collar or flange of the saw blade driving motor housing and is adjustably tilted in a ripping operation so as to guard one side of the saw blade against accidental radial contact therewith while at the same time exposing more than one-half of the other side of the saw blade. The retractable, pivoted lower guard devices have been susceptable to lateral contact with the saw blade and to distortion and consequent malfunctioning when subjected to impacts incidental to the operation of a radial arm saw.

Also, these prior devices do not provide adequate protection against accidental operator contact with the saw blade from both axial and radial directions nor do they effectively retain and direct sawdust upward to the usual collecting outlet.

Accordingly, I have provided a one piece saw blade guard for a radial arm saw which is freely movable vertically and freely falls to a downward position wherein it extends over the entire saw blade thereby providing greater protection against accidental operator contact with the saw blade from axial and radial directions, which is reliable in operation and of sufficiently rigid construction to withstand impacts incidental to operation of a radial arm saw which would tend to move it laterally into contact with the saw blade and which is effective in collecting sawdust.

OBJECTS OF THE INVENTION

The primary object of this invention is to provide a generally new and improved saw blade guard for the suspended saw blade of a radial arm saw which provides substantially greater protection for an operator against accidental contact with the saw blade than prior devices, is reliable in operation and of such construction as to withstand impacts which occur in the operation.

A further object is to provide a one piece, hood-like saw blade guard for a radial arm saw blade which is freely movable vertically to a downward position in which it extends over and shrouds the entire saw blade and is contoured so as to be easily elevated when contacted by a horizontally moving workpiece or when moving horizontally into contact with a stationary workpiece.

A further object is to provide a saw blade guard as in the preceding paragraph which is effective in collecting sawdust.

A further object is to provide a guard for a radial arm saw blade which is guided for substantially frictionless, linear, vertical movement on a support frame detachably connected to the suspended saw blade support housing.

A further object is to provide a hood-like saw blade guard for a radial arm saw which is vertically slidable on a support frame fixed to the saw blade support housing so as to extend over various portions or all of the saw blade and which is slidably removable upward from the support frame so as to provide ready access to the saw blade for replacement.

A further object is to provide a vertically slidable saw blade guard as in the preceding paragraph which includes a retractable hold-down pin mounted for vertical adjustment in the support frame to hold down and to limit the upward movement of the guard to the upper surface of a workpiece and thereby hold down the workpiece on which it is resting.

Further objects and advantages of the invention will become apparent when reading the following description in connection with the accompanying drawings.

IN THE DRAWINGS

FIG. 10 is a rear side elevational view of the vertically slidable guard;

FIG. 11 is a right end elevational view of the guard shown in FIG. 10;

FIG. 12 is a left end elevational view of the guard shown in FIG. 10;

FIG. 13 is a fragmentary cross-sectional view showing the connection of the guide rails to the rear side of the guard and is taken along line 13—13 of FIG. 10;

FIG. 14 is a fragmentary cross-sectional view of the guard and is taken along line 14—14 of FIG. 10;

FIG. 15 is a fragmentary cross-sectional view of the guard and is taken along line 15—15 of FIG. 10; and FIG. 16 is a cross-sectional view of the vertically adjustable hold-down means for the guard and is taken along line 16—16 of FIG. 6.

DESCRIPTION OF A PREFERRED FORM OF THE INVENTION

Figure 2:
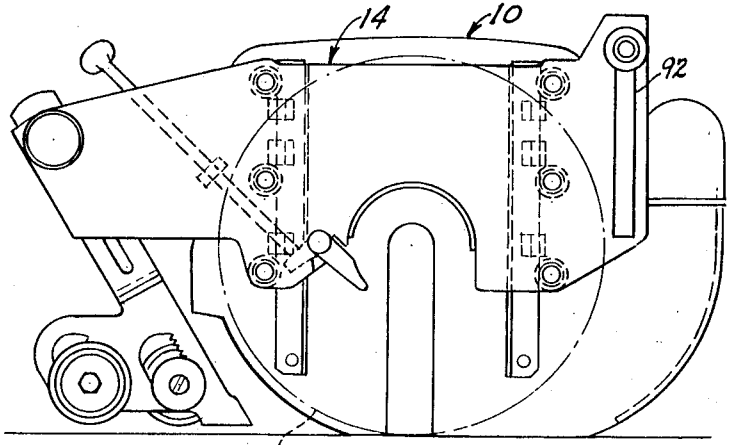
FIG. 2 is a rear elevational view of the guard and support frame shown in FIG. 1.
Figure 4:
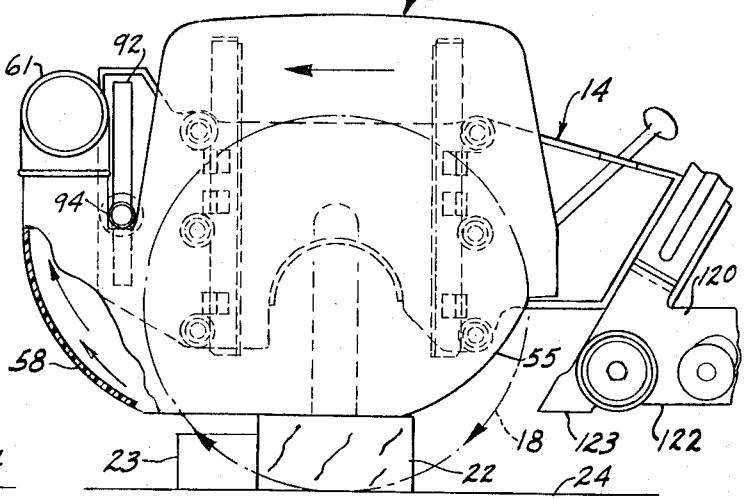
FIG. 4 is a front elevational view of the guard shown in an elevated position resting on the upper surface of a workpiece being cross-cut.
Figure 1:
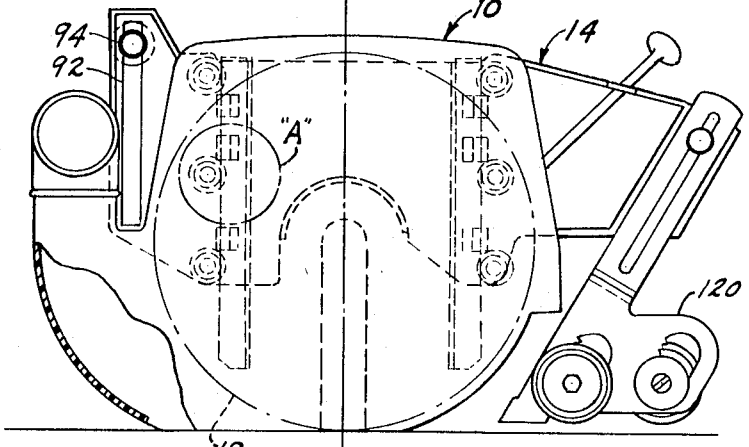
FIG. 1 is a front elevational view of a saw blade guard and support frame for a radial arm saw constructed in accordance with the present invention. In this view the guard is shown in its downward position extending over and shrouding the entire saw blade.
Figure 3:
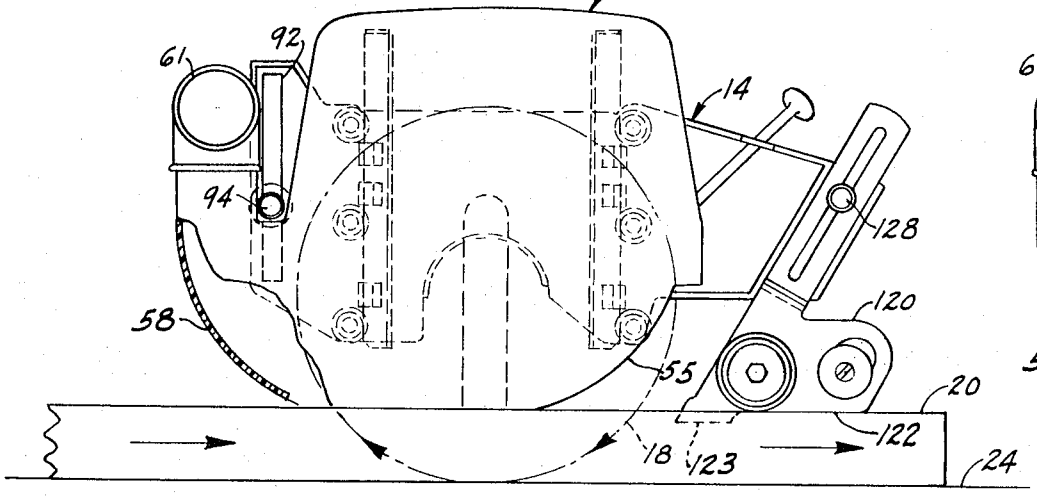
FIG. 3 is a front elevational view of the guard shown in an elevated position resting on the upper surface of an elongated workpiece being ripped by the saw blade.

Referring to the drawings, a one piece, hood-like saw blade guard 10, open at the bottom, is mounted for free sliding vertical movement on a support frame 14 which frame is detachably fixed on the saw blade support housing of a radial arm saw. When in its downward position, as shown in FIGS. 1 and 2, the guard 10 extends over and shrouds the entire saw blade 18, which is indicated by dot-dash line. The guard is free to fall by gravity to this downward position and is contoured on one side thereof so as to be easily moved upward on frame 14 in ripping when contacted by a workpiece 20 moving horizontally on the surface of worktable 24 so as to rest on the upper surface of the workpiece 20 as shown in FIG. 3 and is contoured on the other side thereof so as to be moved similarly upward when the horizontally moving guard 10 contacts a stationary workpiece 22 is cross-cutting, as shown in FIG. 4.

While the guard 10 may be constructed of any suitable material and in any manner suitable to the purpose it is preferably constructed of a light weight, high impact strength, transparent, thermoplastic material and formed as two molded sections suitably joined along a vertical line "Y" to form a one piece, hood-like guard, see FIGS. 10 to 12. The guard 10 consists of substantially flat and parallel front and rear vertical walls 26 and 28 respectively spaced and joined by top and sidewalls 29. The guard 10 is open at the bottom with straight horizontal front and rear bottom wall edges. A substantailly centered positioned vertical slot 30 in the rear wall 28 extends upward from the bottom edge thereof to approximately mid-height of the wall to receive the horizontal saw blade shaft and cylindrical supporting projection 31 and permit vertical movement of the guard, see FIG. 5.

Spaced horizontally on opposite sides of slot 30 are a pair of vertically extending, angle form guide rails 32 attached by screws 33 to vertically extending integral bosses 34 projecting from the surface of rear wall 28 which therefore space the rails from wall 28. The guide rails 32, see FIG. 8, each have a long leg 36 parallel with and attached to the rear wall 28 and a short leg 38 perpendicular thereto. Stiffening ribs 40 integral with the wall 28 and extending laterally from bosses 34 toward slot 30, ribs 42 framing the slot 30 and ribs 44 extending along the bottom edge of wall 28 together with the bosses 34 and attached guide rails 32 considerably enhance the rigidity of the rear wall 28. The front wall 26 of the guard is also stiffened by vertically and horizontally extending integrally formed ribs 46 and 48 framing the upper half of the wall and vertically and horizontally extending ribs 50 and 52 framing the lower half of front wall 26, see FIGS. 11, 12 and 14. The stiffening ribs, bosses and guide rails on the front and rear walls of the guard permit reducing the thickness and therefore the weight of the guard while maintaining the desired rigidity and impact resistance.

The joining wall portion 29 on the left hand side of the guard in FIG. 10 extends downward somewhat below mid-height of the guard and therefore the center of the saw blade when the guard is in its downward position as indicated at 54. Below the edge of joining sidewall portion 54 the left hand edges of the front and rear walls are curved inward at 55 so as to facilitate lifting the guard when that side of the guard is contacted by a horizontally moving workpiece or when the saw blade and guard are moved horizontally toward a stationary workpiece. On its right hand side in FIG. 10 the guard has a rightward offset lower half portion indicated at 56 which is formed by rightward extensions of lower half portions of the front and rear walls and a lower portion 58 of the sidewall 29 which extends downward to substantially the straight bottom edges of the front and rear walls. At its upper end the offset portion 56 has an upwardly directed opening 60 fitted with an elbow 61 for emission of sawdust.

The edges of the front and rear wall portions of the offset portion 56 and the joining sidewall portion 58 and also curved inwardly so as to facilitate lifting the guard when that side of the guard contacts a workpiece. The purposes of providing the offset portion 56 is to permit the lower edge of the sidewall portion 58 to clear the saw blade and permit upward removal of the guard from the frame 14 and to provide a sawdust chute for directing sawdust upward to opening 60 at the upper end of offset portion 56.

Figures 5, 6, 7, 8, 9:
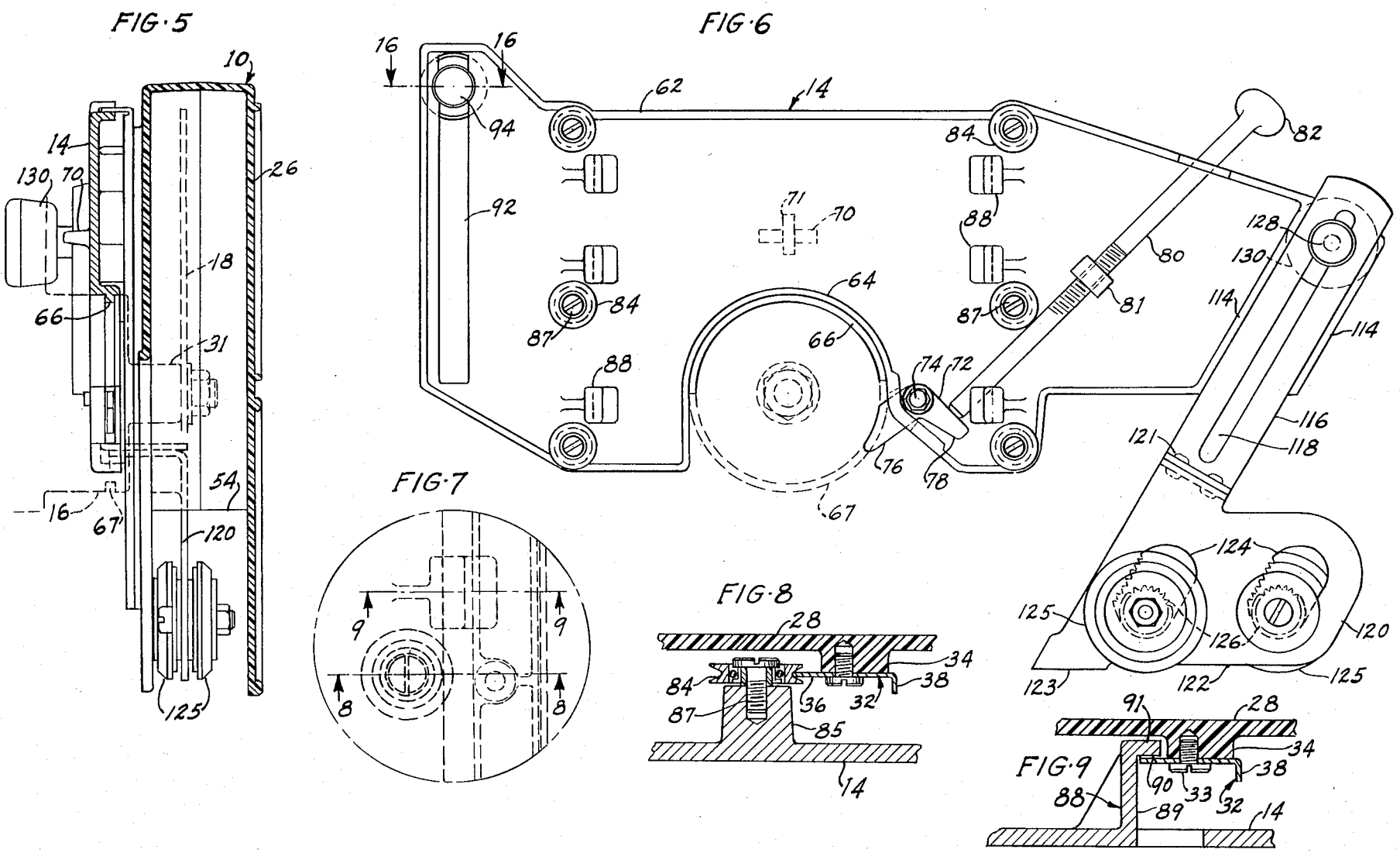
FIG. 5 is an enlarged cross-sectional view of the guard and support frame taken along line 5—5 of FIG. 1.
FIG. 6 is an enlarged front elevational view of the support frame.
FIG. 7 is an enlarged detail view of a portion "A" of FIG. 1 enclosed by a dot-dash line.
FIG. 8 is a cross-sectional view of a roller and guide rail taken along line 8—8 of FIG. 7.
FIG. 9 is a cross-sectional view of a retaining guide boss and is taken along line 9—9 of FIG. 7.

Referring to FIG. 6, the support frame 14 comprises a flat, horizontally elongated plate arranged to be detachably connected in a vertical plane to the saw blade support housing 16. The frame 14 has a forwardly extending stiffening flange 62 extending around the periphery thereof. On its lower side the frame has a substantially semi-circular cutout 64 therein with a radially inward projecting, semi-circular tongue 66 arranged for fitting entry into an annular groove 67 formed in a cylindrical projection 16 of the saw blade support housing. A pair of integrally formed, horizontally spaced lugs 70, positioned above the cutout 64 and projecting from the rear surface of the frame are arranged to receive therebetween on element 71 fixed to and projecting from the saw blade support housing thereby to prevent angular movement of the frame. Means for detachably clamping the frame to the saw blade support housing comprises a bell crank 72 pivotally mounted on the frame at 74. The bell crank has one leg 76 with an arcuate end surface arranged to enter the groove 67 in the saw blade support housing and a second leg 78 engaged by the lower end of a long clamping screw 80. The clamping screw 80 is threadedly engaged in a screw threaded bore extending through an integrally formed lug 81 projecting from the front surface of the frame and extends upward beyond the frame to a handle 82. The screw 80 is also guided in a perforated forward projecting of flange 62.

Mounted in vertical alignment on the front of frame 14 and on opposite sides of cutout 64 are two vertically aligned series of V-grooved, ball bearing rollers 84 which receive edge portions of the long legs 36 of the angle guide rails 32 attached to the guard and provide substantially frictionless guide means for vertical, linear movement of the guard 10 and its retention on frame 14. The rollers 84 are attached to vertically elongated, integral bosses 85 projecting from the forward surface of frame 14 by screws 87 and are therefore spaced from the surface of the frame. As will be seen the guard 10 is readily assembled on or removed from the frame 14. The upper ends of legs 36 of the guide rails are formed horizontally at 86 and engage the top of frame 14 thereby to limit the downward movement of the guard by gravity.

Vertically aligned retention lugs 88 interspaced between rollers 84 and projecting from the front surface of frame 14 have surfaces 89 extending perpendicular from the frame surface and surfaces 90 and 91 spaced from and parallel with the frame surface. Referring to FIGS. 8 and 9 the surfaces 89, 90 and 91 of lugs 88 are spaced relative to rollers 84 so that when the guard 10 is assembled on frame 14 with the rails 32 entered into the V-grooves of the rollers the surfaces 89 and 90 will be slightly spaced from the edge and one side of rail legs 36 and the surface 91 spaced slightly from the rear wall 28 of the guard. The retention lugs 88 therefore permit free vertical movement of the guard on the frame while ensuring the retention of the rails 32 in the V-grooves of the rollers 84 against axially or radially directed impacts tending to dislodge them.

A vertically extending slot 92 in the support frame 14 near its left side in FIG. 6 receives a vertically adjustable horizontal hold-down pin 94 arranged to bear against a short upper horizontal portion 96 of the offset guard portion 56 thereby to variably limit upward movement of the guard. The pin 94 is retractable and extends forward from the front side of the support frame and overlies the horizontal wall portion 96 and is biased in this position by a spring 98.

Referring to FIG. 16, the hold-down pin 94 also extends rearwardly of the frame through a hollow, externally screw threaded member 100 and through a hollow pull knob 102 and is retained therein against the bias of spring 98 by a C-washer 104. The hollow externally screw threaded member 100 has a head consisting of a square portion 106 fittingly entered into and slidable in slot 92 and a circular flange portion 108 bearing against the front surface of frame 14. Threadedly engaged on the rearwardly extending hollow screw threaded member 100 is a round, serrated nut 110 and there is a washer between the nut 110 and the rear surface of the frame. The arrangement is such that the hold-down pin 94 may be retracted from its biased position overlying the guard surface 96 by pulling on the knob 102 so that the guard may be removed vertically from the frame. Also in this arrangement the spring 98 constantly maintains the square portion 106 of the head in slot 92 and the flange portion 108 against the frame. The pin 94 may be adjustably positioned vertically in slot 92 by loosening circular nut 110 and then locked in adjusted position by again tightening nut 110.

Referring to FIG. 6, a right hand portion of the frame 14 extends rightward beyond the guard 10 when assembled thereon and has an oblique guide channel thereon defined by the spaced obliquely extending and parallel flange portions 114 which project forwardly from the front surface of the frame. Guided between these flange portions for longitudinal movement is an elongated flat member 116 having a central elongated slot 118 therein. At its lower end member 116 has a parallel, forwardly offset, flat spreader member 120 connected thereto by rivets 121. The spreader 120 has a straight horizontal lower edge 122 and a forward toe portion 123 extending downwardly thereform for entrance into the kerf of a workpiece being ripped. The spreader 120 is aligned with saw blade 18, see FIG. 5.

Spreader 120 has two horizontally spaced, obliquely extending slots 124 therein lying substantially parallel with the member 116. Slots 124 have teeth along one longitudinal side thereof forming a rack and a smooth opposite side and each slot has a wheel and pinion assembly 125-126 loosely mounted therein for sliding movement thereby providing anti-kickback means for both sides of the kerf of a workpiece being ripped. The construction and operation of this two-wheel type anti-kickback device is fully shown and described in the copending application Ser. No. 340103 filed Jan. 18, 1982 in the names of Kenneth J. Krusemark and James L. Stackhouse, Jr. Means for locking the member 116 and attached spreader and anti-kickback device in various elevated positions on the frame comprises a screw 128 extending through slot 128 and through an aperture in the frame and having a head bearing against member 116 and a knob 130 threadedly engaged on the screw 128 and bearing against the rear side of the frame 14.

OPERATION

When preparing to cross-cut a workpiece 22 resting on the worktable 24, as illustrated in FIG. 4, the spreader 120 and attached anti-kickback device are positioned so that the lower extremity of the spreader and the wheels 125 are just slightly above the upper surface of the workpiece and the hold-down pin 94 is positioned so as to limit the upward movement of the guard to just slightly above the upper surface of the workpiece. In these positions the spreader and attached wheels of the anti-kickback device will guard against accidental radial approach to the saw blade and the hold-down pin 94 will prevent any accidental upward movement of the guard above the workpiece. It will be understood that to attain the fullest protection provided by the guard that any guide fence 23 employed should not extend substantially higher above the worktable than the workpiece.

When now the saw blade and guard are moved horizontally in a feeding direction, as indicated by the arrow and into contact with the workpiece 22 the guard will be lifted due to the contoured side 58 thereof so that the lower horizontal surface of the guard rests on the upper surface of the workpiece. When in this position sawdust thrown leftward and upward by the saw blade rotating in the direction of the arrows will be retained within the guard and directed upward through the curved chute formed by the offset 56 to the opening 60 and through the elbow 61 and suitable conduit to a receptacle (not shown). When the saw blade and guard have traveled sufficiently in the feeding direction the guard will fall to its downward position and upon return movement of the saw blade and guard in an opposite direction the guard will be elevated by contact of its opposite contoured surface 55 to pass over the workpiece. It will also be understood that if a fence 23 extending above the surface of the workpiece is employed the guard will be elevated to the upper surface of the fence in which case the hold-down pin will have to be adjusted to accommodate the fence.

When preparing to rip a workpiece 20 as illustrated in FIG. 3, the hold-down pin 94 is locked in a vertically adjusted position which will limit upward movement of the guard to the upper surface of the workpiece and the spreader 120 is locked in a vertically adjusted position which will align its lower edge 122 with the upper surface of the workpiece. When the workpiece 20 is now fed toward the saw blade in the direction of the arrows the guard will be lifted upon contact of the workpiece with the closed contoured side 58 of the guard to the upper surface of the workpiece whereupon the workpiece will be held down by the guard against its frequent and aggravating tendency to rise from the table caused by rotation of the saw blade. The positioning of the spreader with its lower edge 122 aligned with the upper surface of the workpiece will cause the toe portion 123 thereof to enter the kerf of the workpiece as it is fed past the saw blade. This positioning of the spreader will also cause the wheels 125 of the anti-kickback device to be elevated from their resting positions at the bottoms of slots 124 so as to rest on the upper surface of the ripped workpiece on both sides of the kerf as the workpiece contacts the wheels.

The foregoing description of a preferred embodiment of the invention is intended to be illustrative and not limiting, the scope of the invention being set forth in the appended claims.

I claim:

1. A guard assembly for a radial arm saw having a circular saw blade mounted on a horizontal shaft and a support therefor suspending the saw blade above a horizontal worktable comprising: a guard support frame mounted on said saw blade support, a one piece hood-like guard for extension over said entire saw blade, means mounting said guard for guided vertical movement on said frame and said means being constructed and arranged to permit said guard to fall freely to a downward position wherein it extends over said entire saw blade and permits free removal of said guard upward from said frame, said guard comprising front and rear vertical walls spaced from opposite faces of said saw blade, said walls having top, side and bottom edges and joining top and sidewalls, the lower portions of said side edges at both sides of said walls extending inward to said bottom edges, said joining sidewall at one side of said guard extending substantially to said bottom edges, the lower portions of said front and rear walls and said joining sidewall at one side of said guard being offset outward sufficiently to clear said saw blade, and the lower end of said joining sidewall at the other side of said guard being spaced upward from said bottom edges sufficiently to clear said saw blade whereby a lower portion of said guard at said other side is open, and a spreader and an anti-kickback device mounted for vertical adjustment on said frame and positionable to block approach to said saw blade through said other open lower side.

2. The guard assembly claimed in claim 1 in which said support frame has a vertical wall spaced from and facing said rear wall of said guard and in which said means mounting said guard for vertical guided movement on said frame comprises two horizontally spaced and vertically aligned series of grooved rollers mounted on said frame wall and two horizontally spaced and vertically arranged guide rails mounted on said rear guard wall and having oppositely extending legs entered into the grooves of said grooved rollers, and in which a plurality of lug elements fixed to and projecting from said frame wall and having portions thereof extending between said legs and said rear guard wall maintain the spacing of said facing guard and frame walls.

3. The guard assembly claimed in claim 1 which further includes a guard hold-down means comprising a member mounted for vertical adjustment on said frame and a retractable, horizontal hold-down pin slidable horizontally in said member and biased to a position overlying said guard.

* * * * *